United States Patent [19]

Gadbois et al.

[11] 4,182,616

[45] Jan. 8, 1980

[54] METHOD OF MAKING A ROTATABLE FLOOR TREATING PAD

[75] Inventors: Richard T. Gadbois, Edina; Richard A. Matthews, Lino Lakes Township, Anoka County, both of Minn.

[73] Assignee: Minnesota Mining and Manufacturing Company, Saint Paul, Minn.

[21] Appl. No.: 878,703

[22] Filed: Feb. 17, 1978

[51] Int. Cl.[2] ..... B24D 11/02; B24D 3/32

[52] U.S. Cl. ..... 51/295; 51/298; 51/395

[58] Field of Search ..... 51/401, 402, 403, 404, 51/394, 293, 297, 298.1, 395, 295, 298

[56] References Cited

U.S. PATENT DOCUMENTS

| | | | |
|---|---|---|---|
| 2,046,988 | 7/1936 | Winter | 51/297 |
| 2,229,982 | 1/1941 | Mansur et al. | 51/297 |
| 2,958,593 | 11/1960 | Hoover et al. | 51/295 |
| 3,016,294 | 1/1962 | Haywood | 51/298.1 |
| 3,020,139 | 2/1962 | Camp et al. | 51/298.1 |
| 3,181,193 | 5/1965 | Nobles et al. | 15/114 |
| 3,357,141 | 1/1964 | Annis | 51/394 |
| 3,529,385 | 9/1970 | Stein | 51/394 |
| 4,004,316 | 1/1977 | Ali | 51/364 |
| 4,011,063 | 3/1977 | Johnston | 51/296 |

*Primary Examiner*—Donald J. Arnold

*Attorney, Agent, or Firm*—Cruzan Alexander; Donald M. Sell; Richard Francis

[57] ABSTRACT

A rotatable floor treating pad is provided by uniformly modifying a strip of conformable low-density abrasive product to provide an expandable zone on one side, a contractable zone on the other side, or both, each or a combination of which permits formation of the strip into an annulus without buckling, forming an annulus of the strip and setting the formed annulus to cause it to maintain its shape.

7 Claims, 11 Drawing Figures

METHOD OF MAKING A ROTATABLE FLOOR TREATING PAD

BACKGROUND OF THE INVENTION

1. Field of the Invention

This invention relates to floor treating pads, and more specifically, to a novel method of making a rotatable floor treating pad of low-density abrasive product. The invention also relates to an elongate strip made as a result of the method, a rotatable pad made by the method and a helix made by conforming the elongate strip into a helical shape.

2. Prior Art

The low-density abrasive products of the type defined in U.S. Pat. No. 2,958,593 and sold under the trade designation "Scotch-Brite" by the 3M Company of St. Paul, Minnesota have found a great commercial success in use as floor treating pads. This type of abrasive product is typically formed of crimped staple fibers which have been formed into a mat and impregnated with adhesive and abrasive. The pads are available in any of a wide variety of types to provide many functions. Some pads are extremely abrasive and are desirably used for wax stripping and cleaning floor surfaces which are heavily encrusted with soil. Others are mildly abrasive and are typically used for floor polishing, with or without the prior application of wax.

The pads of this type are typically cut in a circular shape to be used in conjunction with a floor polishing machine. Such machines have a means for engaging or holding the pad therein while rotating the pad against the surface being treated. One highly commercially successful engaging means is that described by Kleemeier et al in U.S. Pat. No. 3,527,001.

The circular pads are typically cut from a larger sheet of the nonwoven abrasive product to form discs. Such a cutting operation, as may be expected, produces a certain amount of wasted material which increases the cost of each individual disc because a certain amount of the material must be discarded. Not only does this increase the cost of production, but it also creates a disposal problem since there is no known economic use for the residue remaining after the discs have been cut.

Certain U.S. patents suggest alternative methods of converting or cutting the nonwoven abrasive product but none has suggested a completely satisfactory solution to the problem. For example, U.S. Pat. No. 3,529,385 discloses making an abrasive brush out of an annulus of endwise stacked rectangular segments of the abrasive product. U.S. Pat. No. 4,004,316 discloses an arrangement of similarly endwise disposed folded segments made of the abrasive material held in place by a rotatable mechanical hub. U.S. Pat. No. 3,181,193 discloses a floor cleaning brush composed of similarly endwise disposed segments of the nonwoven abrasive product in stacked collections between conventional brush segments to form a rotatable annulus. Each of the devices disclosed in these patents requires cutting, stacking and/or assembling of separate segments of nonwoven abrasive material to produce the floor pad or brush. While the segments may be converted or cut with little or no waste, production of the floor pad therefrom requires timeconsuming handling steps and/or expensive hubs or other mechanical fastening devices. Moreover, such methods require the endwise orientation of the nonwoven abrasive segments. This prevents the generally more uniformly abrasive original face of the nonwoven abrasive product from being used.

U.S. Pat. No. 3,357,141 discloses a baseboard and floor cleaning brush which employs a single strip of nonwoven abrasive material in either a pleated arrangement in an endwise disposition for use or in a slit helical arrangement with the original face exposed for rotation. The latter-mentioned brush arrangement of this patent, however, would be unsuited for use as a rotatable floor treating pad since it has an inherently weak outer edge which virtually precludes its ability to be used to heel during a cleaning operation. The ability to heel is an essential requirement of a successful commercial cleaning pad. Heeling involves twisting and forcing down the handle of a rotary floor treating machine to permit an edge of the working face of the pad to bear down on a small area, lifting the remaining portion of the working face of the rotary pad off the floor. This causes the full weight of the machine to be directed upon the small area of the edge of the pad.

SUMMARY OF THE INVENTION

The invention provides a method of making a rotatable floor treating pad which produces substantially no waste material, yet which produces a novel rotatable floor treating pad which is equal or superior in performance to pads made by conventional methods.

The method of the invention involves uniformly modifying an elongate strip of conformable low-density nonwoven abrasive product to provide throughout its length an expandable zone, a contractable zone or both. The elongate strip has a generally rectangular cross-section with flat top and bottom faces, which preferably are parallel, and straight side edges, also preferably parallel. Before modification, the elongate strip also is at least about 3 inches wide and at least ¼ inch thick to provide the necessary thickness and area in the resultant modified pad to perform, without failure, substantially all floor treating operations.

The expandable zone is at least adjacent one side edge and may extend throughout the width of the elongate strip. The expandable zone is such that, as the pad is formed into an annular shape with the expandable zone directed outward, the annular shape will remain substantially planer, without buckling. The expandable zone may be provided in part by a pattern of uniformly spaced slits which extend into the strip from the one side edge a distance up to about 35% of the width of the strip to be formed into the rotatable pad. if the slits extend much beyond about 35% of the width of the strip, there will be produced a pad which will not heel and may disintegrate because of an insufficiency of material at its periphery. The pad may disintegrate as heeling is attempted or else the machine engaging means or skirt will contact the floor while heeling is attempted.

The contractable zone is at least adjacent the other side of the elongate strip. It too is provided in a manner which will not permit buckling of the strip when it is formed into an annular shape with the contractable zone directed inward.

In each situation, where the pad has an expandable zone, a contractable zone or both, the annular shape provided, upon forming, will necessarily have flat floor-contacting surfaces derived from the flat faces of the elongate strip.

The most preferred method involves dividing lengthwise a strip of conformable, low-density abrasive product having parallel sides to provide two elongate strips each having a complementary undulated edge opposite one of the sides. The undulated edge provides a contractable zone in each elongate strip which has repeating undulations or projections, the tops of which preferably define a line parallel to the remaining unmodified straight side edge. Each elongate strip is then slit to provide an expandable zone by a first pattern of slits perpendicular to and extending from the straight side edge toward the center of each of the projections, a second pattern of slits, with each slit in the second pattern spaced from and perpendicular to the straight side edge of the elongate strip and each slit being centered between each of the first slits, and directed toward a point midway between each of the projections. Each elongate strip is then formed into an annular shape with the undulated edge directed inward with its ends abutted, and is set in that shape to cause it to maintain its circular shape. The novel elongate strip having an undulated edge and slit in the manner described above can easily be conformed into a circular shape without buckling. As the conforming takes place, the slits expand to provide slots or openings, depending on their location in the pad, to prevent buckling.

The resulting circular rotatable floor treating pad has a plurality of equally spaced slots on its outer edge and a central opening defined by the tops of the projections which become closely spaced and radially aligned. The second pattern of slits forms a pattern of perforations or openings which are equally spaced within the strip, spaced from the outer edge and aligned with the slots.

The lofty, nonwoven abrasive pads which may be converted or modified to provide articles in accord with the invention are presently commercially available and well known in the art. An adequate description of their preparation may be found in assignee's U.S. Pat. No. 2,958,593 and U.S. patent application Ser. No. 422,918, filed Dec. 7, 1973 now U.S. Pat. No. 4,078,340. The disclosures of this patent and patent application are incorporated herein by reference for their teaching of the production of the lofty, nonwoven abrasive products. Commercially available lofty, nonwoven abrasive products useful in the present invention include that sold under the trade designation "Scotch-Brite" by the 3M Company of St. Paul, Minn.

The converting or modifying steps described above may be advantageously carried out by employing a slitting die having a knife edge in the pattern corresponding to a desired pattern of modification. Continuous converting operations are possible for commercial production with rotating slitting dies and the like. Other means known in the art for providing such modification may also be employed, provided they are compatible with the nature of the lofty, nonwoven abrasive product being modified.

Once the elongate strip is fashioned into an annulus-shaped configuration, it may be advantageously set by applying a suitable curable adhesive to the pad (before or after forming it into an annulus) and curing the adhesive to provide a solid set product. Quite surprisingly, it has been found that conventional commercially available lofty, nonwoven abrasive material such as that sold under the trade designation "Scotch-Brite" by the 3M Company of St. Paul, Minn. will retain its set structure merely upon brief exposure to heat at a temperature in the range of 90° C. to 175° C.

The invention may be further understood by reference to the accompanying drawings, wherein like parts are indicated by similar reference numerals throughout the several views and wherein.

Figure 1:
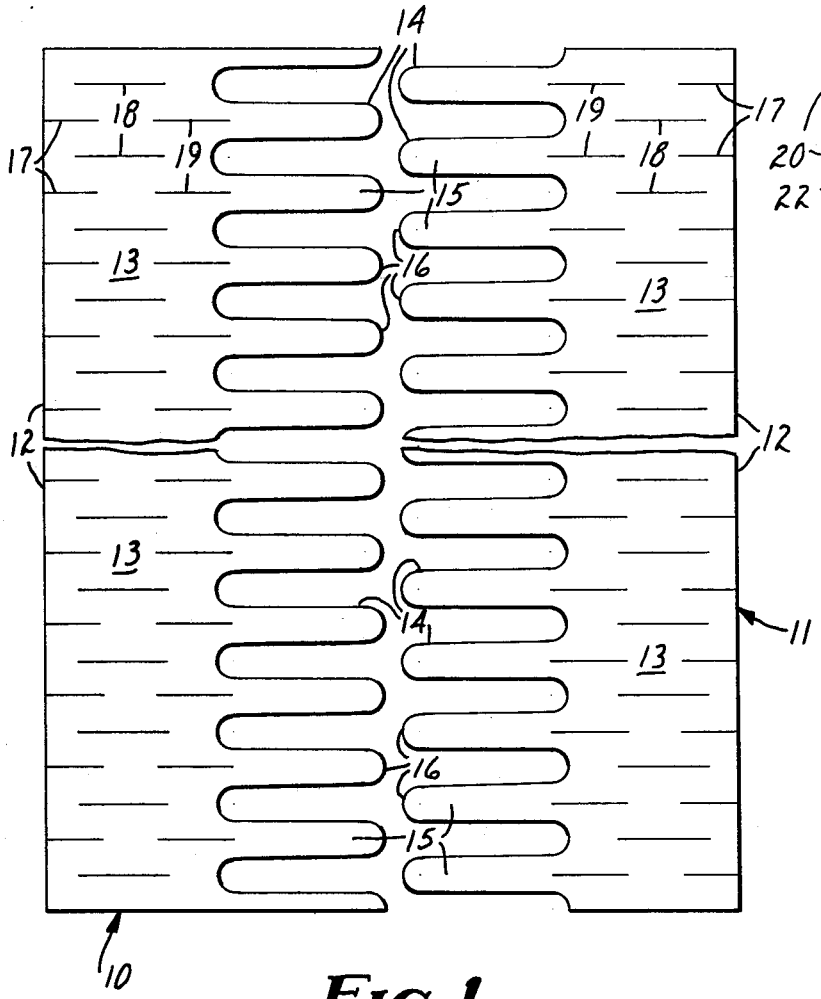
FIG. 1 is a plan view of an elongate strip of lofty, nonwoven abrasive product which has been modified in accord with the invention.

Referring to the drawings, a strip of lofty, nonwoven abrasive material (such as that sold under the trade designation "Scotch-Brite") is modified by providing throughout its length a contractable zone, an expandable zone, or both. Two of such strips (e.g., 10 and 11), shown in FIG. 1, may be produced by dividing lengthwise a strip of conformable, low-density, lofty abrasive product having parallel side edges 12 and flat, preferably parallel, faces (only the top face being visible) 13 to provide a serpentine or undulated edge 14, producing a contractable zone characterized by repeating fingers or projections 15, the tops 16 of which define a line parallel to side edge 12. Each modified elongate strip may then be provided with an expandable zone by slitting to provide a first pattern of slits 17 perpendicular to and extending from side edge 12 toward the center of each of projections 15 and a second pattern of slits 18. Each slit 18 in the second pattern is spaced from and perpendicular to side edge 12 and centered between slits 17 and directed to a point midway between the projections 15.

Figure 2:
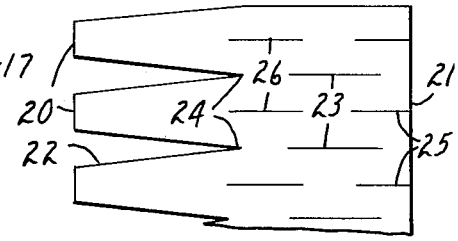
FIG. 2 is a plan view of a segment of a modified elongate lofty, nonwoven abrasive strip.
Figure 7:
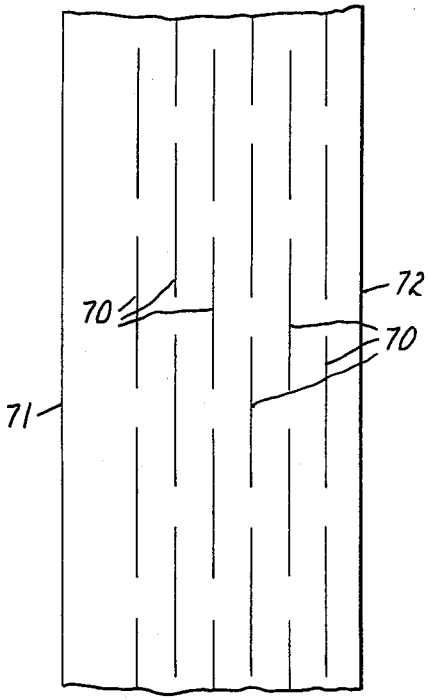

It should be understood that any of a variety of means of providing the contractable zone and/or expandable zone would be equally useful, provided a modified strip as herein defined is produced. For example, the projections may be truncated pyramid in shape, as shown in FIG. 2, or they may be any of a variety of finger-like projections. Preferred projections provide a complementary pattern so that two modified strips can be formed from a single piece of starting material with little or no waste. The contractable zone may be provided by a pattern of uniformily spaced parallel rows of uniformly spaced aligned slits 70 of equal length parallel to sides 71 and 72, as shown in FIG. 7.

Figure 4:
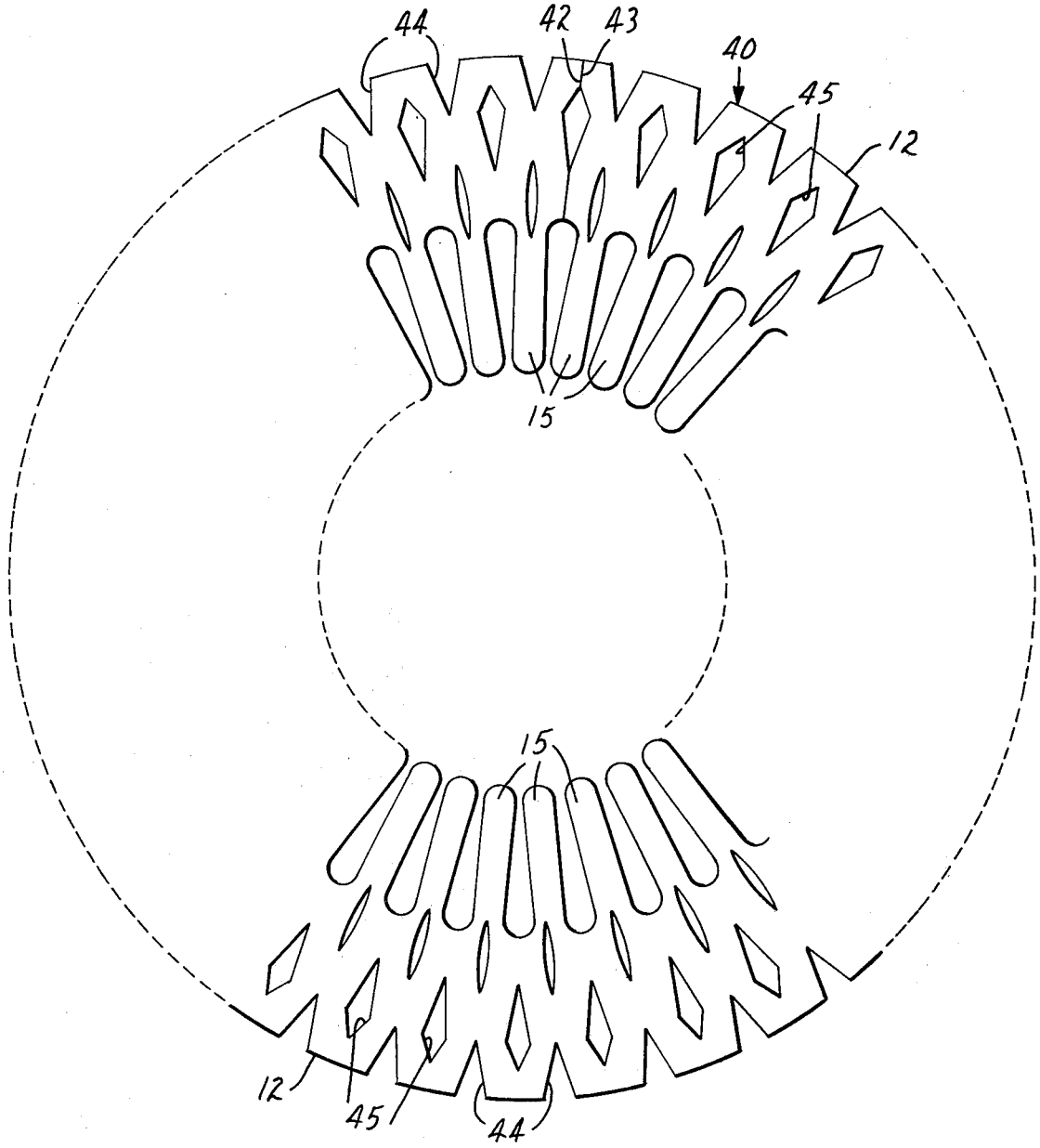
FIG. 4 is a rotatable abrasive pad made in accord with the present invention.

FIG. 4 shows an elongate strip 41 modified as shown in FIG. 1 and formed into an annulus to provide a rotatable floor-treating pad 40. As can be seen, ends 42 and 43 of the elongate strip 41 are abutted to form an annulus. It should be noted that the perimeter of the annulus will not necessarily be identical to the original side edge 12 of the modified elongate strip since there may be some expansion provided by expansible zone and/or some contraction provided by the contractable zone. Slits in the original side edge will provide notches 44 about the periphery of the annulus. Slits within the body of the annulus will provide openings, e.g., diamond-shaped openings 45.

Figure 3:
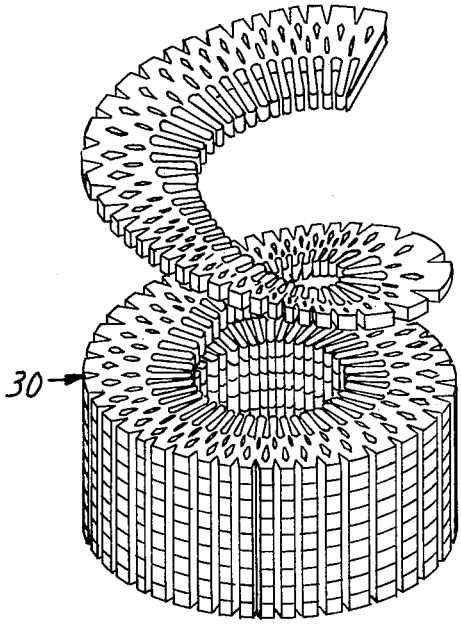
FIG. 3 is a perspective view of a helix formed of a continuous elongate lofty, non-woven abrasive strip modified according to the present invention.

The modified elongate strip may be coiled as a helix 30, as shown in FIG. 3, and sold as such to the user. Helix 30 can be conveniently stored in a cylindrical container or a plastic bag conforming to its general shape. The user would then cut a sufficient length of the elongate strip to form a rotatable pad for his particular machine. This would be a great advantage since neither the supplier nor the user would be required to stock all of the different size rotatable pads as is presently required. The elongate strip forming the helix could be conveniently marked with repeating designations which would indicate the length to be cut for one or more particular sizes of rotatable pads.

The abutted ends of the helix forming the rotatable pad of the invention may be fastened together for use or they may merely be abutted. It has been found that the engaging means described in aforementioned U.S. Pat. No. 3,527,001 is extremely effective for holding a rotatable pad without requiring fastening of the abutted edges. Where separation may be a problem, the abutted edges could conveniently be fastened together by sewing, hook and loop type fastening devices, adhesive bonding, mechanical fastening devices, and the like. Other modifications of the invention may be made without departing from the scope of the claims.

EXAMPLES

The invention is further illustrated by the following examples, wherein all parts are by weight, unless otherwise indicated.

EXAMPLE 1

A 6 inch wide, 44 inches long, 1 inch thick strip of nonwoven, low-density abrasive product (sold under the trade designation "Scotch-Brite" 51 Line Red Buffer Material) was modified, as shown in FIG. 2 of the drawing, to provide a contractable zone adjacent one side edge 20 and an expandable zone adjacent the opposite side edge 21. The contractable zone, a saw-tooth pattern, was provided by cutting and removing, on 1¼ inch centers, ¾ inch wide, 3 inch high triangular pieces from side edge (at the base), leaving triangular notches 22, uniformly spaced ½ inch apart along side edge 20.

The expandable zone was provided by three patterns of uniformly spaced slits. In the first pattern of slits, each slit 23 was 1¾ inch long, perpendicular to the side edges of the strip, aligned with the apex 24 of each triangular notch and spaced ½ inch from side edge 21. In the second pattern of slits, each slit 25 was 1 inch long, parallel with and spaced midway between adjacent slits 23 of the first pattern and extended into the strip from side edge 21. In the third pattern of slits, each slit 26 was 1¾ inch long, aligned with a slit 25 in the second pattern of slits and spaced ¾ inch from the inner end thereof.

The strip as thus modified was formed into a 20 inch diameter annulus with the expandable zone directed outward, held in this shape while heating for approximately five minutes at 150° C. in a hot air oven and removed. The strip thus formed retained its annular shape upon cooling.

EXAMPLE 2

A modified strip as described in Example 1 was further modified by cutting 1 inch of material from the contractable zone side edge, producing a side edge having a saw-tooth pattern, having 2 inch triangular notches spaced ¾ inch apart. The resultant modified strip was formed into an annulus and heat-treated as described in Example 1.

EXAMPLE 3

A modified elongate strip as described in Example 1 was reduced in width by cutting 3 inches of material from the contractable zone side edge, thus removing the contractable zone saw-tooth edge entirely. The resultant modified strip was formed into an annular shape with the expandable outward and heat-treated as described in Example 1.

EXAMPLE 4

As shown in FIG. 1 of the drawing, a 9 inch wide, 44 inch long, 1 inch thick strip of nonwoven, low-density abrasive product (sold under the trade designation "Scotch-Brite" 51 Red Line Buffer Material) was divided lengthwise to provide two elongate strips as shown in FIG. 1. Each strip had a complementary undulated edge having finger-like projections with rounded ends having a 3/16 inch radius of curvature. The projections were approximately 3 inches high and spaced 1¼ inch apart. The strip was further modified by providing an expandable zone by slitting to provide the three patterns of slits as described in Example 1 and as is shown in FIG. 1. Each of the resultant modified strips was formed into an annulus shape and heat-treated as described in Example 1 to provide rotatable annulus as shown in FIG. 4.

EXAMPLE 5

Figure 5:
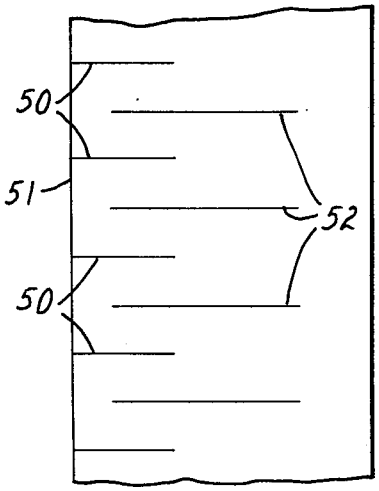
FIGS. 5–11 show plan views of a variety of segments of modified elongate strips made in accord with the present invention.

A 4 inch wide, 30 inch long, 1 inch thick strip of nonwoven abrasive material described in Example 1 was modified to provide an expandable zone therein by two patterns of uniformly spaced slits, as shown in FIG. 5. In the first pattern of slits, each slit 50 was spaced 1¼ inch apart, extended 1¼ inch and was perpendicular to the side edge 51. In the second pattern of slits, each slit 52 was 2½ inches long, commenced ½ inch from side edge 51, and spaced midway between the slits 50 of the first pattern. A 17 inch diameter annulus was then formed with the expandable zone outward and heat-set as described in Example 1.

EXAMPLE 6

Figure 6:
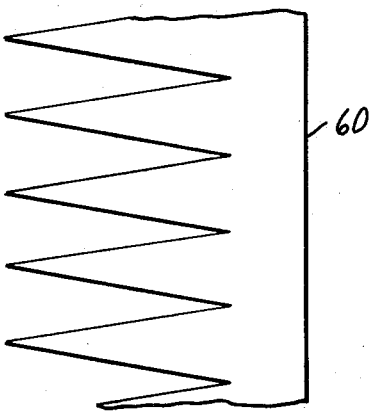

A 4 inch wide, 54 inch long strip of the nonwoven abrasive material described in Example 1 was modified on one side edge to provide a saw-tooth edge by removing equally spaced adjacent 3 inches high (extending into the strip) and a 1 inch wide equalateral triangular segments to provide a modified strip 60 having a contractable zone, as shown in FIG. 6. Strip 60 was then formed, with the contractable zone inward, and heat-set as described in Example 1 to provide a rotatable 17 inch diameter annulus.

EXAMPLE 7

Figure 8:
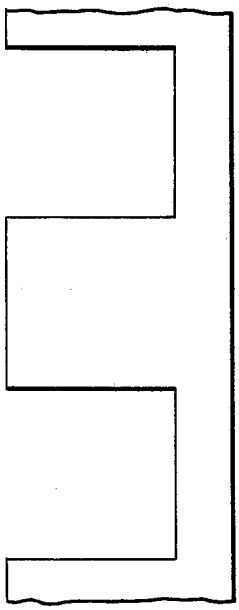

A 4 inch wide 54 inch long strip of the nonwoven abrasive material described in Example 1 was modified by providing a square wave pattern by cutting 3 inch squares on 6 inch centers from one edge, as shown in FIG. 8, to provide a contractable zone. The resultant modified strip was formed, with the contractable zone directed inward, into an annular shape, and heat-set as described in Example 1 to provide a rotatable 17 inch diameter annulus.

EXAMPLE 8

As shown in FIG. 7, a 4 inch wide, 54 inch long elongate strip of nonwoven abrasive product as described in Example 1 was modified to provide 6 spaced parallel rows of aligned spaced 2 inch slits 70. Each row was ½ inch apart and one outer row was spaced 1 inch from the strip side edge 71. Slits in the same row were spaced ½ inch apart and slits in adjacent rows were offset. The modified strip was formed into an annulus with side edge 72 directed inward, causing slits 70 to open and slit sidewalls adjacent side edge 72 to project radially into the central opening of the annulus. The annulus was then heat-set as described in Example 1 to provide a rotatable 17 inch diameter annulus.

EXAMPLE 9

Figure 9:
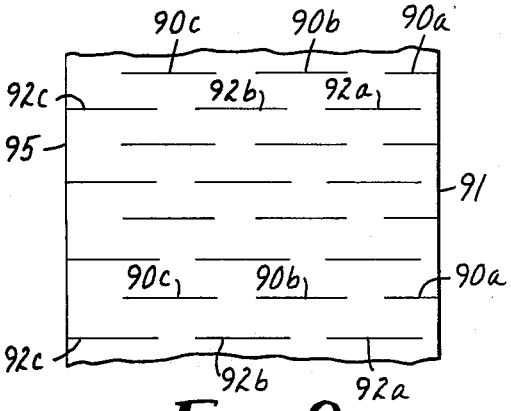

As shown in FIG. 9, a 5 inch wide elongate strip of nonwoven abrasive material as described in Example 1 was modified to provide a repeating sequence of two different arrangements of three aligned spaced slits each, with the slits being perpendicular to the side edges of the strip and spaced 1 inch apart in each arrangement. The first arrangement including 'inch slits 90*a* and 1¼ inch slits 90*b* and 90*c*, was repeated 1 inch apart. Slit 90*a* commenced at side edge 91. Slit 90*c* was spaced ½ inch from side 95. The slits of the second arrangement, including 1¼ inch slits 92*a* and 92*b* and ¾ inch slit 92*c*, were interposed midway between and parallel to the slits of the first arrangement of slits. In the second arrangement of slits, slit 92*a* was spaced ¾ inch from side edge 91. Slit 92*c* commenced on side edge 95 of the strip.

The strip so modified was formed into a 17 inch diameter annulus, with side edge 95 directed inward, and heat-set as described in Example 1 to form a rotatable annulus.

EXAMPLE 10

Figure 10:
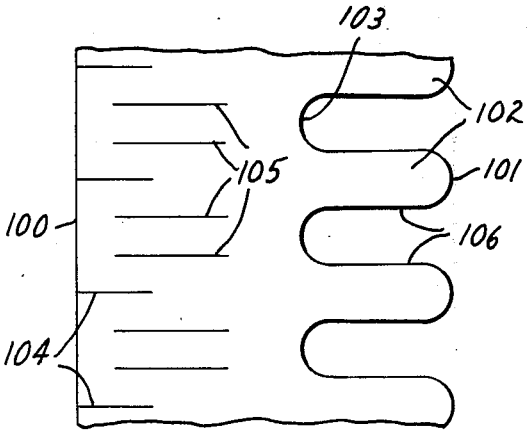

Two modified elongate strips were formed by dividing lengthwise a 5 inch wide, 36 inch long strip of the nonwoven abrasive material described in Example 1. As shown in FIG. 10, which shows a segment of one of such modified strips, each strip included a straight side edge 100 and an undulated edge 101. Undulated edge 101 included approximately 2 inches high and ¾ inch wide fingers 102 having rounded ends with a radius of curvature of ⅜ inch. The spaces 103 between fingers were of a complementary shape and size as fingers 102. An expandable zone was provided by two patterns of slits. The first pattern of slits consisted of 1 inch slits 104 which extended from straight side edge 100 of the pad perpendicular thereto and were directed toward the center of fingers 102. The second pattern of slits consisted of 2 parallel slits 105 2 inches long spaced ½ inch from straight edge 100 of the elongate strip and aligned with the side edges 106 of fingers 102. Each modified strip was formed into a 17 inch diameter annular shape and heat-set as described in Example 1 to provide a rotatable annulus.

EXAMPLE 11

Figure 11:
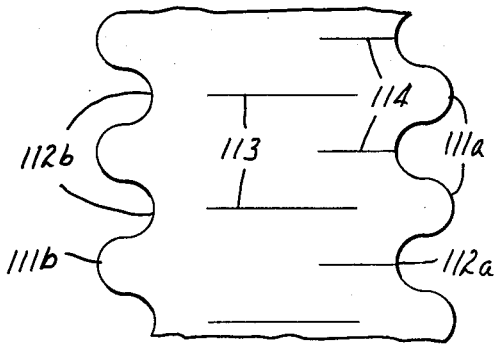

As shown in FIG. 11, a 4¾ inch wide, 36 inch long elongate strip of the nonwoven abrasive material described in Example 1 was modified to provide an undulated edge on each side having protuberances 111*a* and 111*b* separated by complementary size and shape valleys 112*a* and 112*b*, with each of the protuberances on one side of the strip being aligned with a valley on the opposite side. The protuberances were approximately ¾ inch in height, approximately ¾ inch wide and had a ⅜ inch radius of curvature on their rounded ends. The distance between the tops of adjacent protuberances was 1½ inch. The strip was slit to provide two patterns of slits. In the first pattern of slits, a 2 inch long slit 113 extended from a point ¾ of an inch from the bottom of the opposite valley. In the second pattern of slits, a 1 inch slit 114 extended from the bottom of each valley 112*a* on one side of the pad toward the top of a protuberance 111*b* on the opposite side.

Thereafter, the modified slit was formed into an annular shape, with the side containing protuberance 111*a* and valley 112*a* directed outward, shaped and heat-set as described in Example 1 to produce a rotatable 17 inch diameter annulus.

Performance

All of the rotatable annuli described in the foregoing Examples were evaluated as a cleaning pad with a rotatable floor cleaning machine. The rotatable floor treating pads were fitted on near the periphery of a 17 inch diameter engaging means sold under the trade designation "Insta-Lok" driving assembly attached to a 17 inch diameter rotary floor cleaning machine sold under the trade designation "Pacemaker" by the Advance Floor Machine Company of St. Paul, Minn. The machine fitted with the pad in this manner was then used to clean and polish vinylasbestos floor tile. A spray cleaner polish (sold under the trade designation "Scotch-Brite" Brand Systems Sprayer Cleaner A 101 by the 3M Company of St. Paul, Minn. was applied to the floor in the cleaning and polishing operation.

When compared to conventional solid disc-shaped nonwoven abrasive pads of the same material, such as an annulus of the same diameter, each of the rotatable pads described in the foregoing examples produced nearly equal gloss and required about the same amount of electrical energy to operate the rotary floor cleaning machine to clean and polish the floor. Each of the pads of the examples operated without failure over irregularities in the floor surface. The pads made in accord with the present invention were somewhat easier to clean after each use and tended to cause less bounce of the machine during the cleaning and polishing operation.

What is claimed is:

1. A method of making a flat annular pad suitable for use as a pad for a floor treating machine of the type which employs a rotatable pad comprising:

(1) uniformly modifying an elongate strip of conformable low-density abrasive product having flat faces on either side thereof and being at least about 3 inches wide and being at least ¼ inch thick to provide throughout its length at least one of (a) an expandable zone at least adjacent one side which will not permit buckling of said strip when it is formed into a flat annular shape with the expandable zone directed outward, said expandable zone optionally being provided in part by a pattern of uniformly spaced slits which extend into said strip from said one side a distance up to 35% of the width of the strip; or (b) a contractable zone at least adjacent the other side which will not permit buckling of said strip when it is formed into a flat annular shape with the contractable zone directed inward; and (2) forming said strip into a flat annular shape with the expandable zone directed outward or the contractable zone directed inward to provide an annulus having at least one flat floor-contacting surface derived from one of the flat faces of said strip.

2. The method of claim 1 wherein said expandable zone is provided by a pattern of uniformly spaced transverse slits.

3. The method of claim 1 wherein said contractable zone is provided by a pattern of uniformly spaced longitudinally aligned slits.

4. The method of claim 1 wherein said contractable zone is provided by uniformly spaced notches on one edge of said strip.

5. The method of claim 1 also including the step of setting said formed strip to cause it to retain its flat annular shape.

6. A method of making a rotatable floor treating pad comprising:

(1) dividing lengthwise a strip of conformable low-density abrasive product having parallel sides to provide two elongate strips each having a complementary undulated edge opposite one of said sides;

(2) slitting each of said elongate strips to provide a first pattern of slits perpendicular to and extending from said side toward the center of each of said projections, a second pattern of slits each slit spaced from and perpendicular to said side of said elongate strip, centered between the first slits, and directed toward a point midway between projections;

(3) forming said elongate strip into a flat annular shape with the undulated edge directed inward; and (4) setting said formed elongate strip to cause it to maintain its flat annular shape.

7. The method of claim 6 wherein said setting is heat-setting.

* * * * *